US010920592B2

(12) United States Patent
Friedman et al.

(10) Patent No.: US 10,920,592 B2
(45) Date of Patent: Feb. 16, 2021

(54) SYSTEM AND METHOD FOR ASSEMBLING GAS TURBINE ROTOR USING LOCALIZED INDUCTIVE HEATING

(71) Applicant: General Electric Company, Schenectady, NY (US)

(72) Inventors: Michael Ericson Friedman, Simpsonville, SC (US); Minhajuddin Syed, Greer, SC (US); William Michael Michaud, Gray Court, SC (US); Lamont Joseph Lum, Pickens, SC (US)

(73) Assignee: General Electric Company, Schenectady, NY (US)

( * ) Notice: Subject to any disclaimer, the term of this patent is extended or adjusted under 35 U.S.C. 154(b) by 343 days.

(21) Appl. No.: 15/844,065

(22) Filed: Dec. 15, 2017

(65) Prior Publication Data

US 2019/0186265 A1 Jun. 20, 2019

(51) Int. Cl.

| | |
|---|---|
| ***F01D 5/02*** | (2006.01) |
| ***F04D 29/64*** | (2006.01) |
| ***F04D 19/02*** | (2006.01) |
| ***F04D 29/053*** | (2006.01) |
| *H05B 6/10* | (2006.01) |
| *F04D 29/32* | (2006.01) |

(52) U.S. Cl.

CPC ..... *F01D 5/026* (2013.01); *F01D 5/025* (2013.01); *F04D 19/02* (2013.01); *F04D 29/053* (2013.01);

(Continued)

(58) Field of Classification Search

CPC . F01D 5/026; F01D 5/025; F01D 5/06; F01D 5/066; F01D 5/147; F01D 25/285; F04D 29/053; F04D 29/644; F04D 29/329; F05D 2230/232; F05D 2230/64; F05D 2230/642; F05D 2240/24; F05D 2260/30; F05D 2260/36; B23P 11/025;

(Continued)

(56) References Cited

U.S. PATENT DOCUMENTS 2,547,934 A * 4/1951 Gill ..... F02C 7/047 415/232

3,345,732 A 10/1967 Brower (Continued)

FOREIGN PATENT DOCUMENTS

JP 2014167277 A 9/2014

*Primary Examiner* — Courtney D Heinle
*Assistant Examiner* — Sang K Kim
(74) *Attorney, Agent, or Firm* — James Pemrick; Hoffman Warnick LLC

(57) ABSTRACT

A method of assembling a rotor is provided, in which each rotor disk comprising a connecting element. The method includes: (a) applying heat to a localized region of a first rotor disk of a plurality of rotor disks to selectively deflect a first connecting element of the first rotor disk, wherein the first rotor disk is stationary during heating; (b) installing the first rotor disk onto a rotor stack containing at least one rotor disk; and (c) repeating steps (a) and (b) for each rotor disk of the plurality of rotor disks; and (d) allowing the rotor disks, when stacked, to cool. When cooled, the respective connecting element of each rotor disk that has been selectively deflected contracts into an interference fit with an adjacent rotor disk. A system for selectively heating a localized region of a rotor disk is also provided.

11 Claims, 9 Drawing Sheets

(52) U.S. Cl.
CPC ..... *F04D 29/644* (2013.01); *F04D 29/329* (2013.01); *F05D 2230/232* (2013.01); *F05D 2230/64* (2013.01); *F05D 2240/24* (2013.01); *H05B 6/102* (2013.01)

(58) Field of Classification Search
CPC ..... B23P 15/006; B23P 15/008; H05B 6/405; C21D 1/10; C21D 1/42; C21D 9/32
See application file for complete search history.

(56) References Cited

U.S. PATENT DOCUMENTS 4,086,690 A * 5/1978 Bernasconi ..... B23K 9/0282 29/889.2
4,411,715 A 10/1983 Brisken et al.
4,482,293 A 11/1984 Perry
4,567,649 A 2/1986 Ades et al.
4,897,518 A 1/1990 Mucha et al.
5,279,027 A 1/1994 Brown
5,558,495 A 9/1996 Parker et al.
5,746,580 A 5/1998 Parker et al.
5,994,681 A 11/1999 Lloyd
7,258,526 B2 8/2007 Dooley et al.
7,473,475 B1 * 1/2009 Matheny ..... B23K 31/02 428/598
8,573,932 B2 11/2013 Ross et al.
9,145,772 B2 * 9/2015 Baxley ..... F01D 5/082
2010/0181298 A1 * 7/2010 Gindorf ..... B23K 1/0018 219/617
2015/0068216 A1 3/2015 Exnowski et al.
2016/0233750 A1 8/2016 Nibe et al.
2016/0258488 A1 * 9/2016 Lin ..... F16C 35/063
2019/0120055 A1 * 4/2019 Hachard ..... B23P 11/025

* cited by examiner

SYSTEM AND METHOD FOR ASSEMBLING GAS TURBINE ROTOR USING LOCALIZED INDUCTIVE HEATING

TECHNICAL FIELD

The present disclosure relates to the field of gas turbines and, more specifically, to a system and method for assembling a gas turbine rotor using localized inductive heating of the rotor disks.

BACKGROUND

At least some known gas turbine assemblies are used for electrical power generation. Such gas turbine assemblies include a compressor, a combustor, and a turbine. Gas (e.g., ambient air) flows through the compressor, where the gas is compressed before delivery to one or more combustors. In each combustor, the compressed air is combined with fuel and ignited to generate combustion gases. The combustion gases are channeled from each combustor to and through the turbine, thereby driving the turbine, which, in turn, powers an electrical generator coupled to the turbine. The turbine may also drive the compressor by means of a common shaft or rotor.

The rotor of a gas turbine is commonly made of a series of rotor disks, which are stacked on top of one another, aligned with alignment pins, and secured by connecting tie bolts that extend along an axis radially outward of the rotational axis of the rotor. Each of the rotor disks has a central rotor bore that surrounds the rotational (longitudinal) axis of the gas turbine, forming a hollow core. At least some of the rotor disks in the compressor and turbine sections include dovetail or other openings around their radially outermost surfaces for holding blades for those sections. As a result, rotation of the stacked shaft causes rotation of the blades. Some rotors include so-called "spacer disks," which do not include blades but which are included between bladed rotor disks. Spacer disks may be used to ensure the proper spacing of the rotor disks and to prevent the bladed rotor disks from becoming too large or too heavy.

Rotor disks (including spacer disks) may be provided with connecting elements or features that engage an adjacent disk, such that the stacking of the rotor disks results in an interlocked series of rotor disks along the length of the rotor shaft. To accomplish the interlocking, or interference, fit of a specific rotor disk onto the rotor stack atop or adjacent a pre-stacked rotor disk, it has conventionally been necessary to heat the entire rotor disk. The heating of the rotor disk causes thermal expansion of the rotor disk, including the connecting elements or features.

Conventionally, heating of the rotor disk is accomplished by hot air blowers that indiscriminately direct hot air (e.g., air at temperatures around 900° F.) at the rotor disk for a long period of time to increase the bulk temperature of the rotor disk. This method may take several hours to achieve the necessary degree of expansion and, for that reason, the method is time- and energy-intensive. The heated rotor disk is quickly transferred onto the rotor stack to minimize heat loss and associated contraction of the rotor disk.

To expedite the stack-up of the rotor disk, the timing of the heating of each rotor disk must be carefully managed, so that each additional rotor disk is prepared for installation as soon as the previous rotor disk is stacked. In practice, the heating steps for rotor disks used in heavy-duty gas turbines may take four or more hours, and the cool-down step for the stacked rotor may require as many as 24 hours. When the stacked rotor is allowed to cool completely, the rotor disks contract, and the connecting elements of each rotor disk form an interference fit with the adjacent pre-stacked rotor disk.

SUMMARY

It would be useful to provide a method of achieving the degree of thermal expansion or deflection necessary to facilitate assembly without applying heat to an entire rotor disk. Such a preferential heating method would reduce heating time and cool-down time of each rotor disk, thereby significantly reducing the time needed to assemble a fully stacked turbine rotor. Further, such a preferential heating method, by localizing heat in one area of the rotor disk, reduces thermal stresses in the rotor disk.

According to a first aspect of the present disclosure, a method of assembling a rotor comprising a plurality of rotor disks is provided, in which each rotor disk of the plurality of rotor disks comprising a connecting element. The method includes: (a) applying heat to a localized region of a first rotor disk of the plurality of rotor disks to selectively expand a first connecting element of the first rotor disk, wherein the first rotor disk is stationary during the applying of heat; (b) installing the first rotor disk onto a rotor stack containing at least one rotor disk; and (c) repeating steps (a) and (b) for each rotor disk of the plurality of rotor disks; and (d) allowing the plurality of rotor disks, when stacked, to cool. When cooled, the respective connecting element of each rotor disk that has been selectively expanded contracts into an interference fit with an adjacent rotor disk.

According to another aspect of the present disclosure, an inductive heating fixture for selectively heating a localized region of a rotor disk is provided. The inductive heating fixture includes: a frame configured for attachment to existing bolt holes defined within the rotor disk; and at least one inductive heating coil disposed within the frame for inductively heating a localized region of the rotor disk when a current is applied to the at least one inductive heating coil. The inductive heating produces eddy currents that selectively heat the localized region and cause thermal deflection of a connecting element of the rotor disk.

According to a further aspect of the present disclosure, a gas turbine having a rotor assembly with a plurality of rotor disks installed on a rotor shaft is assembled according to the method provided herein.

BRIEF DESCRIPTION OF THE DRAWINGS

The specification, directed to one of ordinary skill in the art, sets forth a full and enabling disclosure of the present products and methods, including the best mode of using the same. The specification refers to the appended figures, in which.

DETAILED DESCRIPTION

The following detailed description illustrates various rotor disks and inductive heating fixtures therefor, which are provided by way of example and not limitation. The description enables one of ordinary skill in the art to make and use the inductive heating fixtures and to assemble or disassemble gas turbine rotors using the preferential inductive heating method prescribed herein. The description provides several embodiments of the inductive heating fixtures, including what are presently believed to be the best modes of making and using the inductive heating fixtures. The present preferential inductive heating method is described herein as being used to assemble a rotor of a heavy-duty gas turbine assembly. However, it is contemplated that the preferential inductive heating method and the corresponding inductive heating fixtures described herein have general application to a broad range of systems in a variety of fields other than electrical power generation.

As used herein, the terms "first", "second", and "third" may be used interchangeably to distinguish one component or embodiment from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The "forward" portion of a component is that portion nearest the compressor inlet, while the "aft" portion of a component is that portion nearest the turbine exhaust.

As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the terms "circumference" or "perimeter" (or any variations thereof) refer to a dimension extending around a center of any suitable shape (e.g., a square, a rectangle, a triangle, etc.) and is not limited to a dimension extending around a center of a circular shape.

Figure 1:
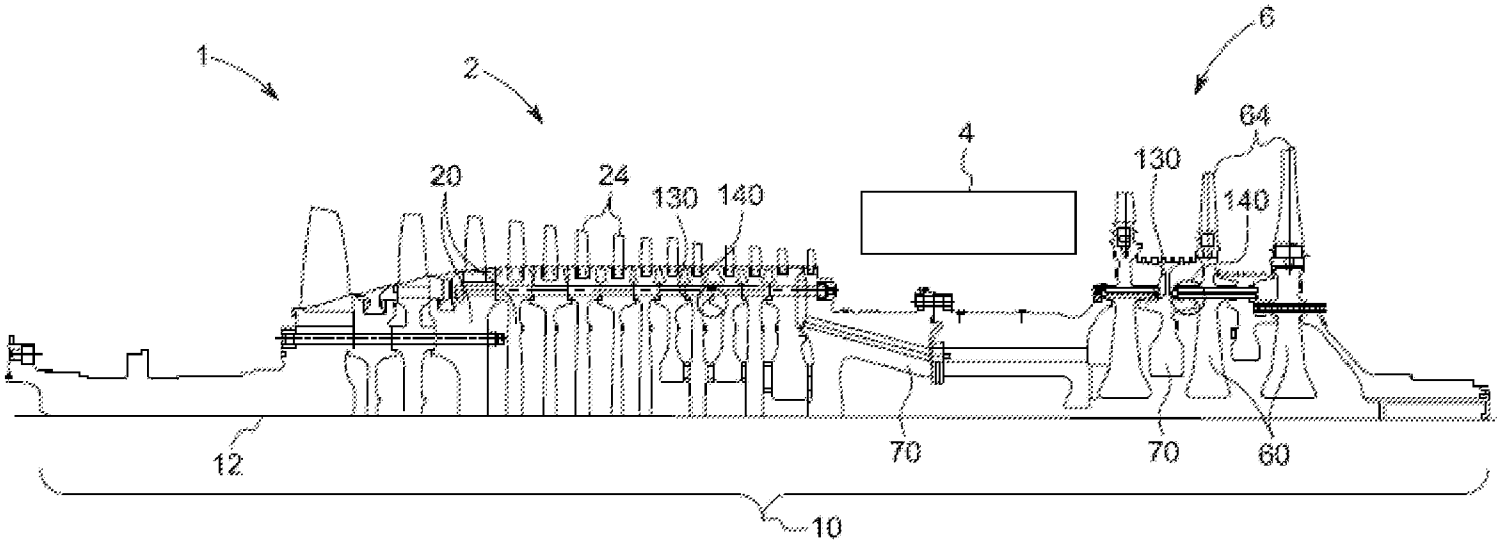
FIG. 1 is a schematic representation of a typical gas turbine.

FIG. 1 is a schematic representation of a portion of a gas turbine 1, as taken in cross-section. The gas turbine 1 typically contains, in sequence, an inlet (not shown) for atmospheric air, a compressor unit 2 having rotatable compressor blades 24, one or more combustors 4, a turbine section 6 having rotatable turbine blades 64, and an outlet (not shown).

Atmospheric air is received by the inlet and passed to the compressor unit 2, where the air is compressed by passing through multiples stages of stationary nozzles and rotating blades 24. The compressed air is directed to the one or more combustors 4, where the compressed air is combined with fuel and combusted. As a result, at least a portion of the compressed air is combusted, thereby producing hot gases having high temperature and high pressure (i.e., the combustion products).

The combustion products are passed through the turbine section 6, which includes stationary nozzles and rotating blades 64, thereby causing the rotating blades 64 to rotate and generate work. After passing through the turbine section 6, the exhaust products (i.e., the de-energized, de-pressurized combustion products) exit the gas turbine 1 through the outlet. The gas turbine 1 may be coupled to a generator (not shown) along a common rotor shaft 10, such that the rotation of the blades 64 causes the generator to produce electricity.

The compressor unit 2 includes axially spaced apart compressor rotor disks 20, which rotate within an external compressor casing (not shown). The compressor rotor disks 20 contain the compressor blades 24, which extend radially outward from the rotor disks 20 toward the external compressor casing.

Similarly, the turbine section 6 includes axially spaced apart turbine rotor disks 60, which rotate within an external turbine casing (not shown). The turbine rotor disks 60 contain the turbine blades 64, which extend radially outward from the rotor disks 60 toward the external turbine casing.

The compressor rotor disks 20 and the turbine rotor disks 60 are arranged along the longitudinal (rotational) axis 12 that extends through the respective rotor bores of the stacked rotor disks 20, 60. In addition to the rotor disks 20, 60, which include slots for receiving the individual compressor blades 24 and turbine blades 64, respectively, a number of spacer disks 70 may be positioned between the rotor disks 20, between the rotor disks 60, upstream of the rotor disks 20 and/or 60, or downstream of the rotor disks 20 and/or 60, as necessary to achieve the desired rotor length and component spacing. For purposes of the present disclosure, the term "rotor disk" is intended to cover both compressor rotor disks 20 that hold compressor blades 24, turbine rotor disks 60 that hold turbine blades 64, and spacer disks 70, regardless of their location along the rotor shaft 10. Accordingly, the number 100 will refer to a generic rotor disk, whether bladed or un-bladed, regardless of its location along the stacked rotor assembly 10.

It is common for rotor disks 100 to include one or more connecting elements 130 that create an interference fit, or interference joint, 140 with an adjacent rotor disk 100. The connecting elements 130 may include protrusions, recessions, notches, or interlocking edges. To assemble the stacked rotor 10, it is necessary to heat each rotor disk 100 to cause expansion of the disk and/or deflection of the connecting element 130. When the rotor disk 100 cools, the contraction of the rotor disk 100 creates the interference joint 140 with an adjacent disk 100.

To accomplish the heating most efficiently in terms of heating time and energy usage, the present method employs inductive heating of a stationary rotor disk 100, which allows heat to be applied selectively, easily, and repeatably to localized regions 150 (see FIG. 4) of each disk 100. For this purpose, customized fixtures are configured for each rotor disk 100, as discussed below, to predictably direct the heat only (or primarily) into the localized regions. Inductive heating is accomplished by providing energy to an induction coil, which generates an alternating electromagnetic field.

The electromagnetic field, in turn, produces eddy currents on the surface of the disk 100. The use of inductive heating in localized regions achieves the biggest deflection of the rotor disk 100 for the least amount of heat energy, leading to reduced heating and cool-down times and thereby decreasing the time required to assemble the stacked rotor assembly 10.

The material and shape of the rotor disk 100 affect the heating of the rotor disk 100. When the rotor disks 100 are made of ferrous materials, approximately 90% of the heat forms on the surface of the disk 100, via ohmic loss to resistance of the material and the induced voltage from the eddy currents. Approximately 10% of the heat is generated internal to the surface of the disk 100, via hysteretic heating due to the rapid magnetization and de-magnetization of the molecules. However, it has been found that the present method of inductive heating is applicable to both ferrous and non-ferrous disks 100.

As discussed in more detail below, in some instances, the localized regions 150 that are inductively heated are adjacent or proximate to the connecting element 130. In other instances, the localized regions 150 that are inductively heated are distal or spaced apart from the connecting element 130. The inductive heat may be applied from the interior of a rotor bore 110 (that is, the central aperture surrounding the rotational axis 12) of a respective rotor disk 100 or from a radially outer surface of the rotor disk 100, and the fixtures 200 are constructed accordingly.

Figure 2:
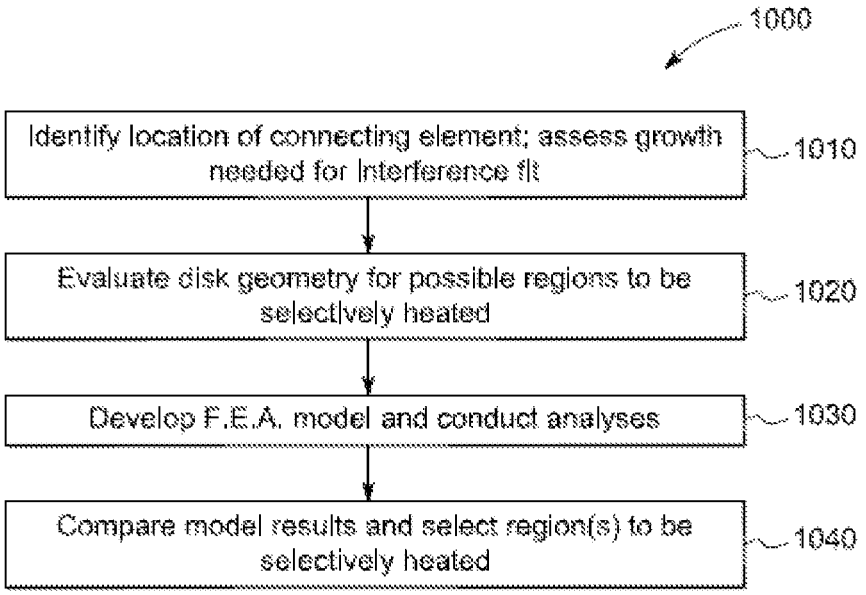
FIG. 2 is a flow diagram of an exemplary process of determining the localized regions of a rotor disk to be selectively heated.

FIG. 2 illustrates steps of an exemplary process 1000 for determining the regions 150 of each rotor disk 100 that are to be selectively heated. In step 1010, the location of the connecting element 130 for a particular rotor disk 100 is identified, and an assessment of the thermal growth or deflection needed to produce the interference fit 140 is made. In step 1020, the geometry (i.e., shape and features) of the particular rotor disk 100 is evaluated to identify possible regions 150 to which heat may be selectively applied.

In step 1030, a finite element analysis (FEA) model is developed using a tool such as ANSYS simulation software or the like. The model includes numerous inputs, such as possible regions 150 to be heated, heating ramp rates, and heating soak times. "Ramp rate" refers to the rate at which the temperature of the heated region 150 increases over time to reach a target temperature needed to achieve the assessed thermal growth or deflection. Ramp rate may be measured in degrees per minute, using either Fahrenheit or Celsius degrees. "Soak time" refers to a period of time during which the heated region 150 is kept at the target temperature to ensure adequate inductive heating of the region 150.

The model calculates the amount of energy needed to achieve the desired thermal growth or deflection and, from that calculation, the number of heating coils (or the number of turns of the heating coil) is determined. The model also evaluates thermal stresses on the rotor disk 100, as may occur with each possible heating region 150, ramp rate, and soak time. The modeling software may rely on a two-dimensional or three-dimensional model of the rotor disk 100.

In step 1040, the results from the FEA model are compared, taking into consideration the thermal stresses on the rotor disk 100, the ramp rate, and the soak time. Based on one or more of these factors, and possibly others, a region 150 of the rotor disk to be selectively heated is identified.

Special consideration is paid to sharp edges, which are defined as those areas where a longitudinal axis of one surface intersects to form a right angle with a radial (or transverse) axis of an adjacent second surface. The longitudinal axis is parallel to the rotational axis 12 and the radial axis extends radially outward from the rotational axis 12. The eddy currents produced by inductive heating often are concentrated at sharp corners, leading to edge effects in which discrete areas adjacent the sharp corners become heated. Depending on the location of the connecting element 130, the edge effects may cause heating apart from the desired localized areas 150, which may unduly stress or overheat the rotor disk 100.

Figure 3:
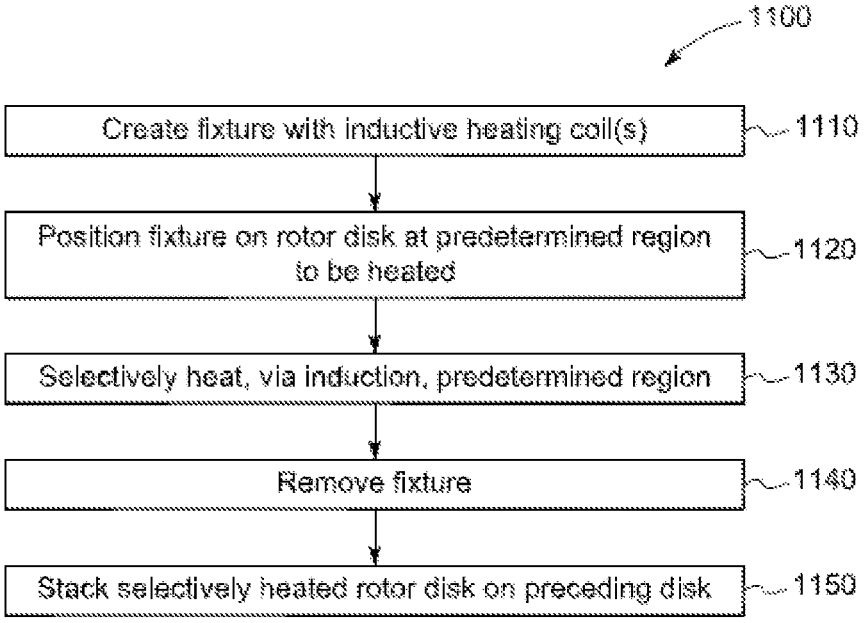
FIG. 3 is a flow diagram of an exemplary process of locally applying heat to the predetermined regions of a rotor disk and stacking the rotor disk.

FIG. 3 illustrates steps of an exemplary process 1100 for assembling a stacked rotor from a number of interconnected rotor disks 100. Once the region 150 to be heated has been identified (as in step 1040 above), a fixture 200 may be produced (step 1110), the fixture 200 housing one or more inductive heating coils 220. The fixture 200 is positioned on the rotor disk 100 at the predetermined region(s) 150 to be heated, as in step 1120. In some instances, the fixture 200 may be configured to be attached temporarily to the rotor disk 100. In other instances, the fixture 200 may be configured to rest on a surface of the rotor disk 100 or within the rotor bore 110 of the rotor disk 100.

When the fixture 200 is in the correct position near the predetermined region 150, the inductive heating coils 220 are connected to a controller 250 (shown in FIG. 5), which directs an electrical current through the coils 220 to produce eddy currents on the surface of the rotor disk 100. The eddy currents are directed at the predetermined, localized region 150, resulting in selective heating of the predetermined regions 150 (step 1130).

The heating of the localized region 150 occurs at the ramp rate and for the soak time determined by the model, as described above. The temperature of a portion of the rotor disk 100 is measured by thermocouples. The portion of the rotor disk 100 whose temperature is measured by the thermocouples and monitored by the controller 250 may be the localized region 150 or may be some other region whose temperature relationship to the localized region 150 is understood.

For instance, if the localized region 150 encompasses the connecting element 130, a thermocouple may be located apart from the localized region 150. If the temperature at the thermocouple location is known to be x % (e.g., 70%) of the temperature of the localized region 150, it is possible for the controller 250 to use the thermocouple measurements to calculate the temperature at the localized region 150 being heated.

When the thermocouple indicates that the localized region 150 has reached the target temperature and the controller 250 determines that the defined soak time has lapsed, the fixture 200 is removed from the rotor disk 100 (step 1140). The rotor disk 100 is then stacked in position on the rotor stack (that is, onto a pre-set, previously heated rotor disk 100), as in step 1150.

Figure 4:
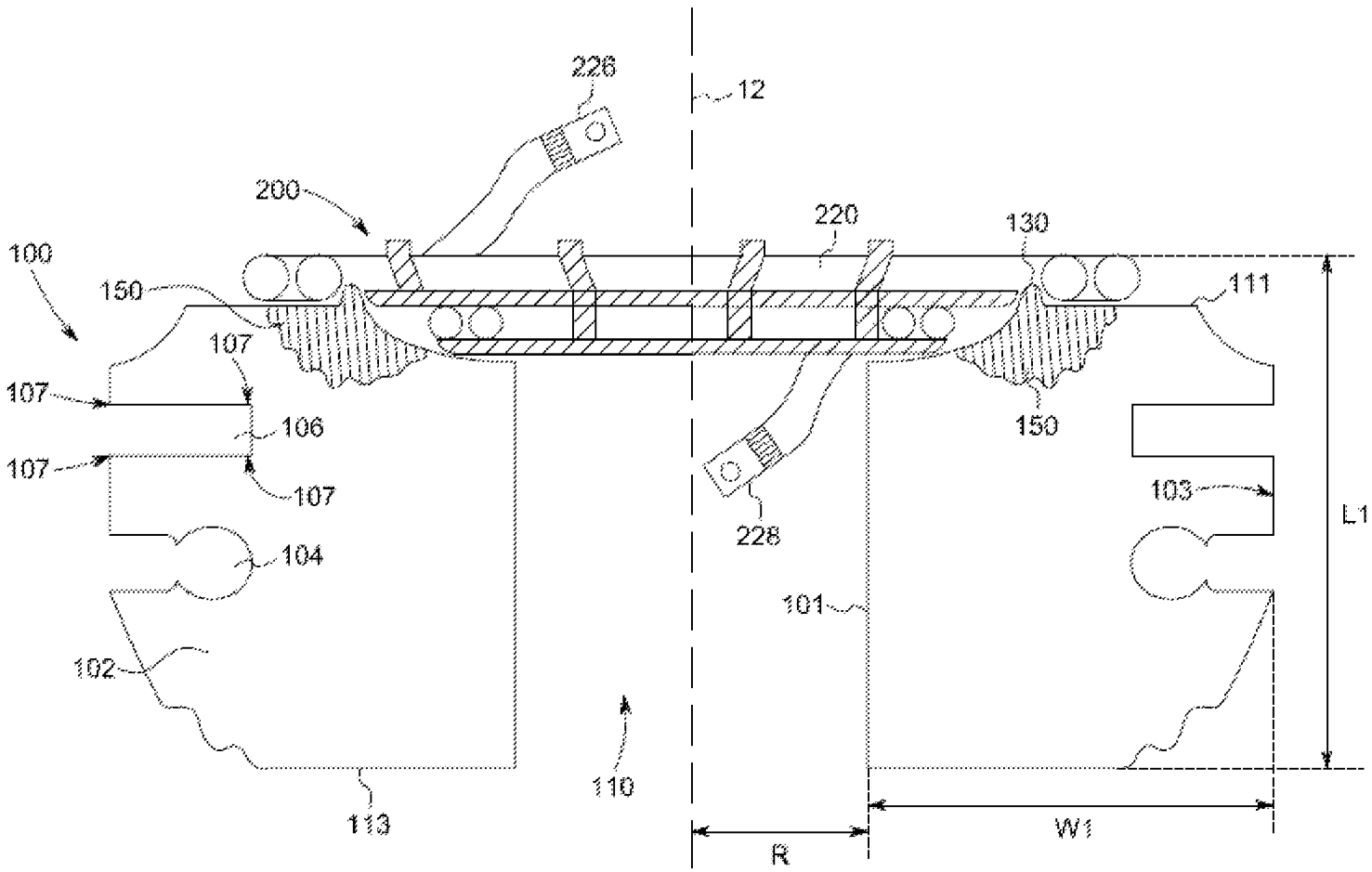
FIG. 4 is a cross-sectional side view of a first rotor disk and a corresponding first inductive heating fixture, according to a first aspect provided herein.

FIG. 4 illustrates an exemplary rotor disk 100, in which inductive heating is applied selectively, using an inductive heating fixture 200, to a surface of the rotor disk 100 containing the connecting element 130. The rotor disk 100 includes a disk body 102 having a length L1 in the axial direction (i.e., along rotational axis 12) between an upstream surface 111 and a downstream surface 113. A width W1 in a radial direction, which is perpendicular to the axis 12, is defined between a radially inner surface 101 and a radially outer surface 103. A distance between the rotational axis 12 and the inner surface 101 of the rotor disk 100 defines a radius R of the rotor bore 110.

The disk body 102 may define a plurality of dovetail slots 104 along the radially outer surface 103 thereof, each slot 104 being configured to hold a respective blade (e.g., 24, 64). The disk body 102 may define other slots or indentations 106, which may define one or more sharp edges 107. As discussed above, selectively heating the rotor disk 100 at localized regions 150 helps to minimize concentration of the eddy currents at the sharp edges 107, thereby minimizing edge effects.

In the exemplary rotor disk 100 shown in FIG. 4, the connecting element 130 is disposed on the upstream surface 111 of the rotor disk in a position between the radially inner surface 101 and the radially outer surface 103 and proximate to the radially inner surface 101. The connecting element 130 circumscribes the rotor bore 110 and projects outwardly from the upstream surface 111. To inductively heat the connecting element 130, the fixture 200 including an inductive heating coil 220 is constructed and positioned on, or attached to, the rotor disk 100. The inductive heating coil 220 generates eddy currents that produce heat in a localized region 150 proximate to the connecting element 130.

Figure 5:
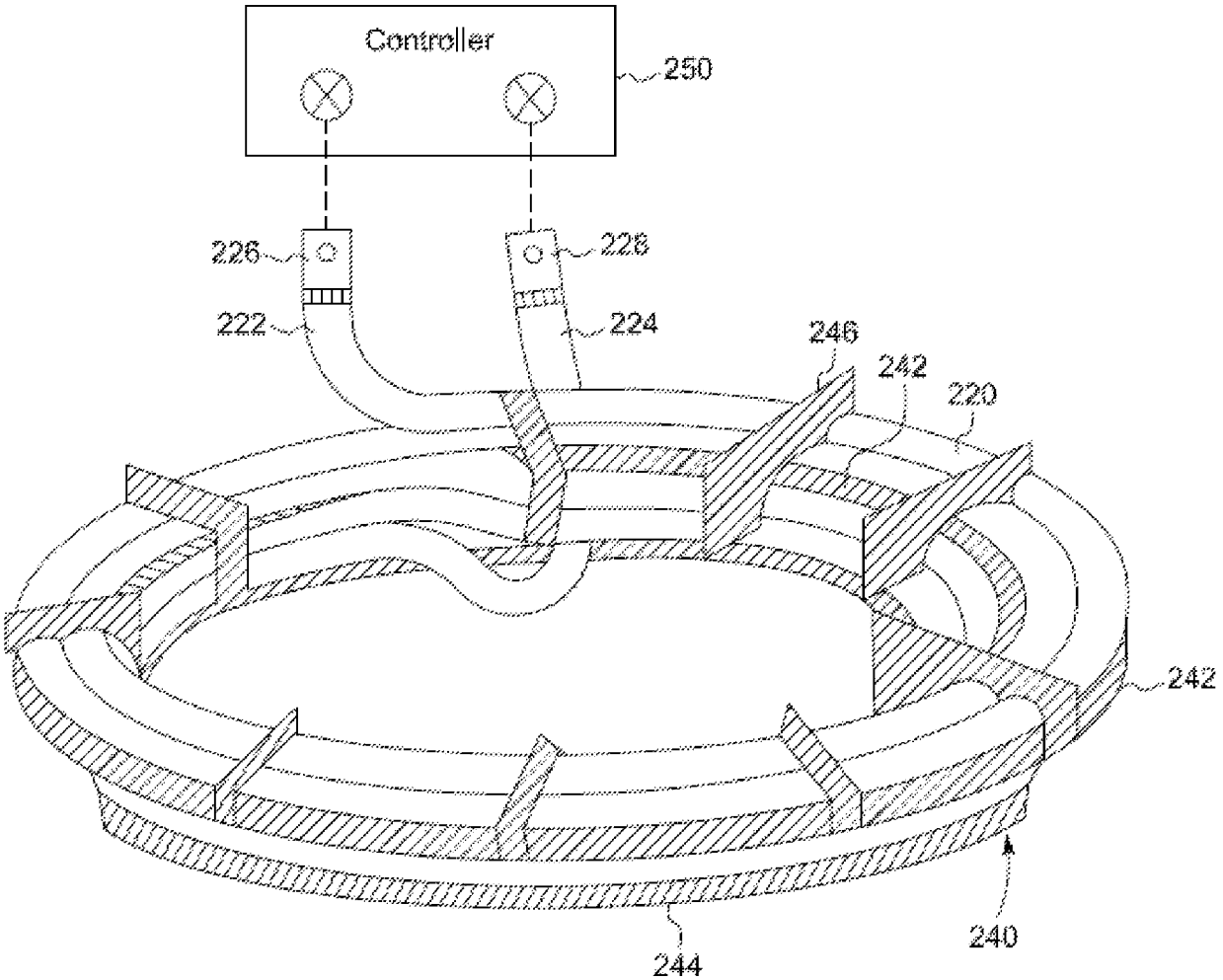
FIG. 5 is a perspective view of the first inductive heating fixture and a controller.

The fixture 200, also shown in FIG. 5, includes a frame 240 that holds the inductive heating coil 220 in a desired shape. In this exemplary configuration, the frame 240 includes a first ring 242, a second ring 244 spaced apart from the first ring 242, and a number of struts 246 encircling the inductive heating coil 220 and connecting the first ring 242 and the second ring 244. The frame 240 is made of a heat-resistant material, such as Teflon® fluorinated polymer, which is relatively lightweight and durable.

As shown in FIG. 5, the heating coil 220 is wrapped helically within the frame 240, such that a continuous circuit is produced. Each end 222, 224 of the heating coil 220 is provided with an electrical connector 226, 228, respectively, which may be crimped onto the heating coil 220. The electrical connectors 226, 228 are connected to a controller 250, which provides electricity to the heating coil 220 and which controls the ramp rate and soak time for the heating process.

Figure 6:
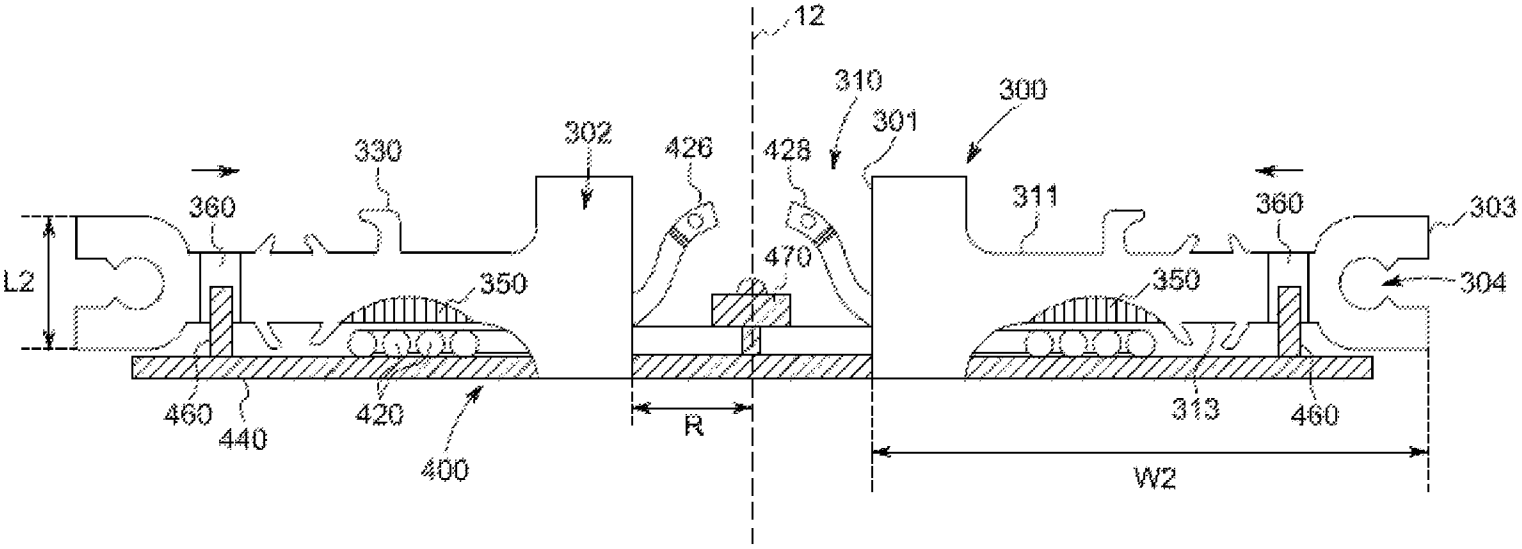
FIG. 6 is a cross-sectional side view of a second rotor disk and a corresponding second inductive heating fixture, according to a second aspect provided herein.

FIG. 6 illustrates an exemplary rotor disk 300, in which inductive heating is applied selectively, using an inductive heating fixture 400, to a surface of the rotor disk 300 opposite a connecting element 330. The rotor disk 300 includes a disk body 302 having a length L2 in the axial direction (i.e., along rotational axis 12) between a most upstream surface 311 and a most downstream surface 313. A width W1 in a radial direction, which is perpendicular to the axis 12, is defined between a radially inner surface 301 and a radially outer surface 303. A distance between the rotational axis 12 and the inner surface 301 of the rotor disk 300 defines the radius R of the rotor bore 310. The disk body 302 may define a plurality of dovetail slots 304 along the radially outer surface 303 thereof, each slot 304 being configured to hold a respective blade (e.g., 24, 64).

In the exemplary rotor disk 300 shown in FIG. 6, the connecting element 330 is disposed on the upstream surface 311 of the rotor disk in a position between the radially inner surface 301 and the radially outer surface 303 and proximate to the radially inner surface 301. The connecting element 330, which has an L-shaped cross-sectional profile, circumscribes the rotor bore 310 and projects outwardly from the upstream surface 311.

To inductively heat the connecting element 330, the fixture 400 including an inductive heating coil 420 is constructed and attached to the rotor disk 300 by inserting alignment pins 460 in tie bolt holes 360 in the rotor disk 300. The tie bolt holes 360 provide a geometric reference point to ensure the fixture 400 is positioned in the correct place to heat a localized region 350. The inductive heating coil 420 generates eddy currents that produce heat in the localized region 350, which, in this instance, is opposite the connecting element 330.

Figure 7:
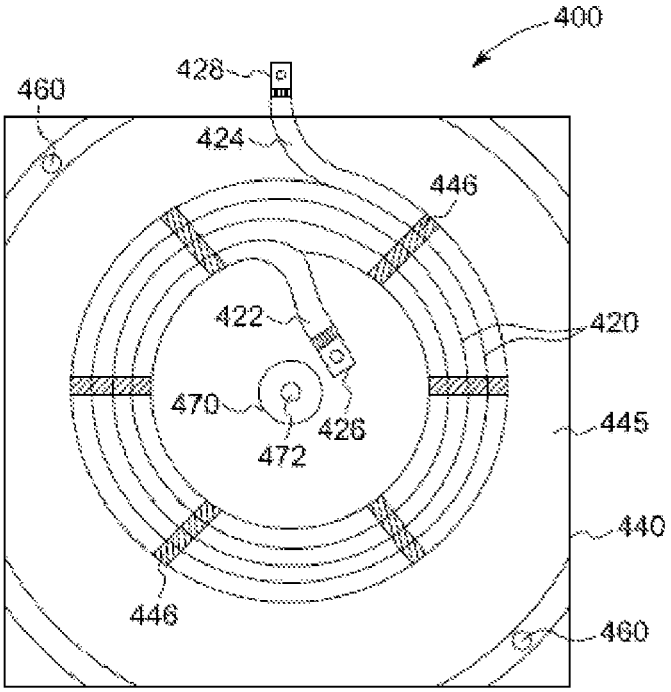
FIG. 7 is an overhead plan view of the second inductive heating fixture, as provided in FIG. 6.

The fixture 400, also shown in FIG. 7, includes a frame 440 that holds the inductive heating coil 420 in a desired shape. In this instance, the heating coil 420 is wound in such a way as to remain generally planar within the frame 440. In this exemplary configuration, the frame 440 includes a generally planar surface 445 upon which the heating coil 420 is positioned and a number of struts 446 encircling the inductive heating coil 420. In the center of the fixture 400, a lift ring 470 may be provided to facilitate transport of the fixture 400. The lift ring 470 may be formed integrally with the planar surface 445, projecting outwardly from the planar surface 445, or may be formed separately from the planar surface 445 and attached with a rivet 472 or other fastener.

As with the fixture 200, each end 322, 324 of the heating coil 320 is provided with an electrical connector 326, 328, respectively, which may be crimped onto the heating coil 320. The electrical connectors 326, 328 are connected to the controller 250 (shown in FIG. 5), which provides electricity to the heating coil 320 and which controls the ramp rate and soak time for the heating process.

Figure 8:
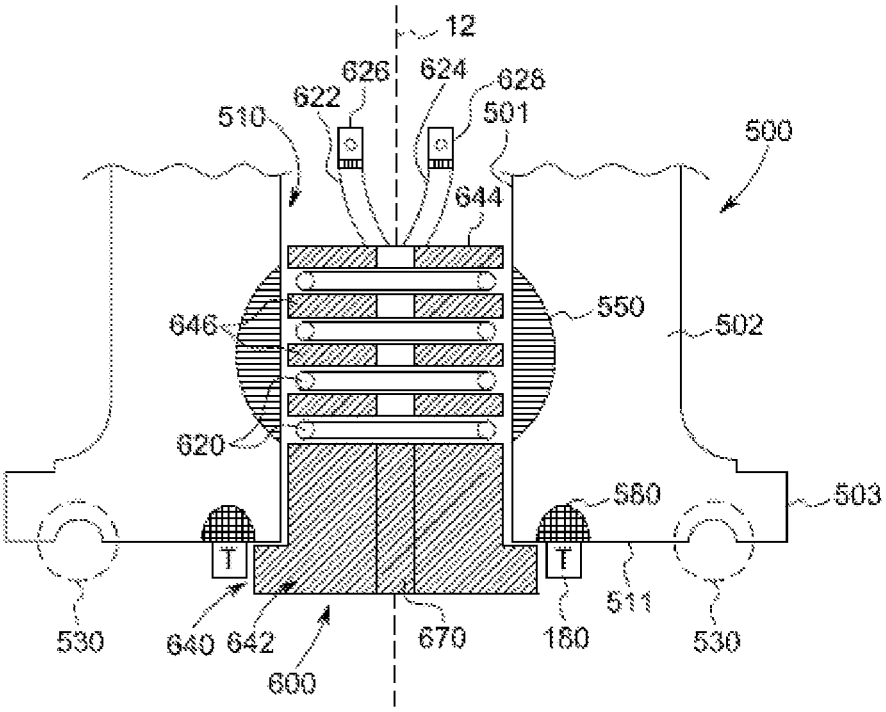
FIG. 8 is a cross-sectional side view of a third rotor disk and a corresponding third inductive heating fixture, according to a third aspect provided herein.

FIG. 8 illustrates an exemplary rotor disk 500, in which inductive heating is applied selectively, using an inductive heating fixture 600, from within a rotor bore 510 distal to a connecting element 530. The rotor disk 500 includes a disk body 502 having an upstream surface 511 and an opposing downstream surface (not shown). The disk body 502 also includes a radially inner surface 501 and a radially outer surface 503. A distance between the rotational axis 12 and the inner surface 501 of the rotor disk 500 defines the radius R (not separately labeled) of the rotor bore 510. The disk body 502 may define a plurality of dovetail slots (not shown) along a portion of the radially outer surface thereof, each slot being configured to hold a respective blade (e.g., 24, 64).

In the exemplary rotor disk 500 shown in FIG. 8, the connecting element 530 is an indention or recess formed in the upstream surface 511 of the rotor disk 500 in a position proximate to the radially outer surface 503. The connecting element 530 circumscribes the rotor bore 510 and is recessed into the upstream surface 511 to form a rabbet. To inductively heat the connecting element 530, the fixture 600 including an inductive heating coil 620 is constructed and inserted into the rotor bore 510. (Alternately, the rotor disk 500 may be lowered onto the fixture 600 using a crane.) The inductive heating coil 620 generates eddy currents that produce heat in a localized region 550 extending inwardly from the inner surface 501 proximate to the heating coil 620. In this example, the localized region 550 is distal to, or far removed from, the connecting element 530.

Figure 9:
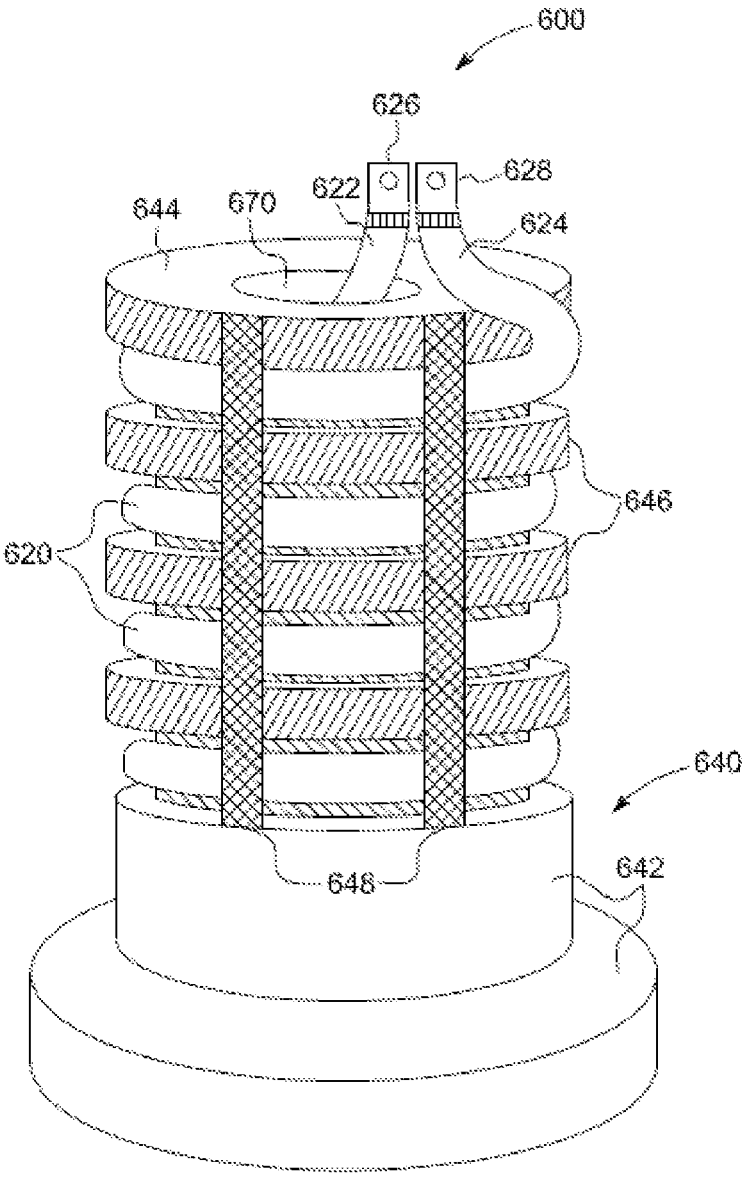
FIG. 9 is a perspective view of the third inductive heating fixture, as shown in FIG. 8.

The fixture 600 (also shown in FIG. 9) includes a frame 640 that holds the inductive heating coil 620 in a desired shape and prevents its direct contact with the inner surface 501 defining the rotor bore 510. In this instance, the heating coil 620 is wound in such a way as to extend over an axial span roughly corresponding to the axial length of the localized region 550. In this exemplary configuration, the frame 640 includes a base 642, a generally planar top surface 644, and a series of stacked platforms 646 around and between which the heating coil 620 is helically wound. A number of struts 648 encircle the inductive heating coil 620 and connect the top surface 644 to the base 642.

A hollow core 670 is provided in the center of the fixture 600 through which hollow core 670 the respective ends 622, 624 of the heating coil 620 may be fed for connection to the controller 250. As with the fixture 200, each end 622, 624 of the heating coil 620 is provided with an electrical connector 626, 628, respectively, which may be crimped onto the heating coil 620.

FIG. 8 further illustrates the location of a pair of thermocouples 180 proximate to the base 640 of the fixture 600. The thermocouples 180 measure the temperature of a measurement zone 580, which is axially spaced from the localized region 550 being heated by the inductive heating coil 620. It should be noted that the thermocouples may be incorporated into the base 642 of the frame 640, if desired.

Temperature measurements from the measurement zone 580 are transmitted to the controller 250, which monitors the temperature and correlates the temperature in the measurement zone 580 with the temperature in the localized region 550. As described above, if the temperature at the thermocouple location (i.e., the measurement zone 580) is known to be x % (e.g., 70%) of the temperature of the localized region 550, it is possible for the controller 250 to use the thermocouple measurements to calculate the temperature at the localized region 550. When the controller 250 indicates that the localized region 550 has reached the target temperature (based on calculations from the thermocouple readings) and the controller 250 determines that the defined soak time has lapsed, the rotor disk 500 is separated from the fixture 600 and stacked on the previously stacked rotor disk(s).

Figure 10:
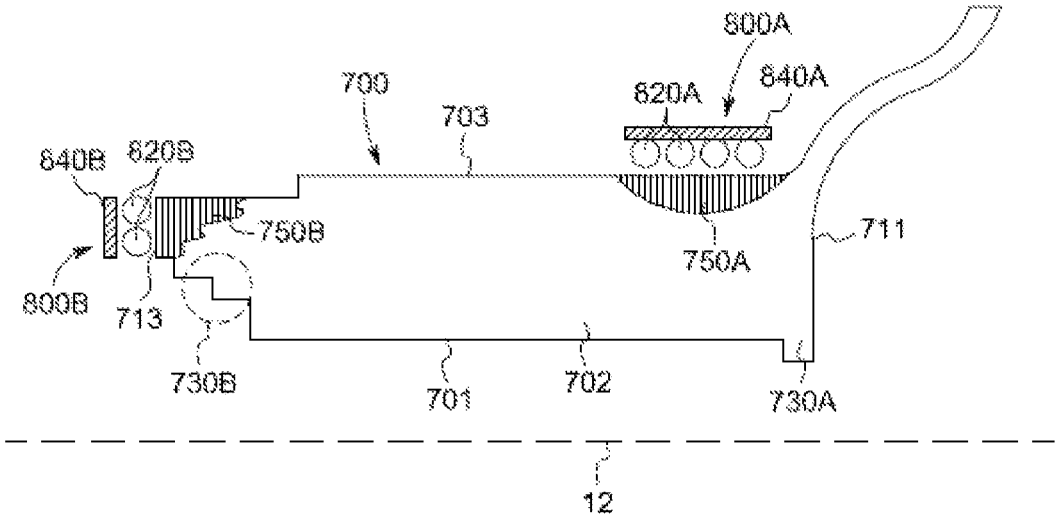
FIG. 10 is a cross-sectional side view of a portion of a fourth rotor disk and a corresponding pair of fourth inductive heating fixtures.

FIG. 10 illustrates a rotor disk 700 having an elongated body 702 with a first connecting element 730A and a second connecting element 730B axially and radially disposed from the first connecting element 730A. The rotor disk 700 includes a radially inner surface 701, a radially outer surface 703 opposite the radially inner surface 701, an upstream surface 711, and a downstream surface 713 generally opposite the upstream surface 711. The first connecting element 730A, which is disposed along the interface between the radially inner surface 701 and the upstream surface 711, projects radially inward of the radially inner surface 701. The second connecting element 730B is a stepped feature that is disposed at the interface between the radially inner surface 701 and the downstream surface 713.

To achieve the deflection needed to create an interference fit with a previously installed rotor disk, the rotor disk 700 is heated in two localized areas 750A and 750B, using two inductive heating fixtures 800A and 800B. The first inductive heating fixture 800A, which includes a first inductive heating coil 820A wound within a first frame 840A, is positioned on the radially outer surface 703 proximate to the upstream surface 711. As electrical current is applied through the inductive heating coil 820A, the localized area 750A is heated. The second inductive heating fixture 800B, which includes a second inductive heating coil 820B wound within a second frame 840B, is positioned on the downstream surface 713 proximate to the stepped, second connecting element 730B. As electrical current is applied through the inductive heating coil 820B, the localized area 750B is heated.

As may be observed, the localized area 750A is larger than the localized area 750B. Accordingly, more turns of the inductive heating coil 820A are used to heat localized area 750A, as compared with the number of turns of the inductive heating coil 820B used to heat localized area 750B. To ensure the timely preparation of the rotor disk 700, it may be advisable to begin heating of the localized area 750A using fixture 800A prior to beginning the heating of the localized area 750B using fixture 800B. Alternately, or additionally, different amounts of energy may be applied to each localized area 750A, 750B.

Figure 11:
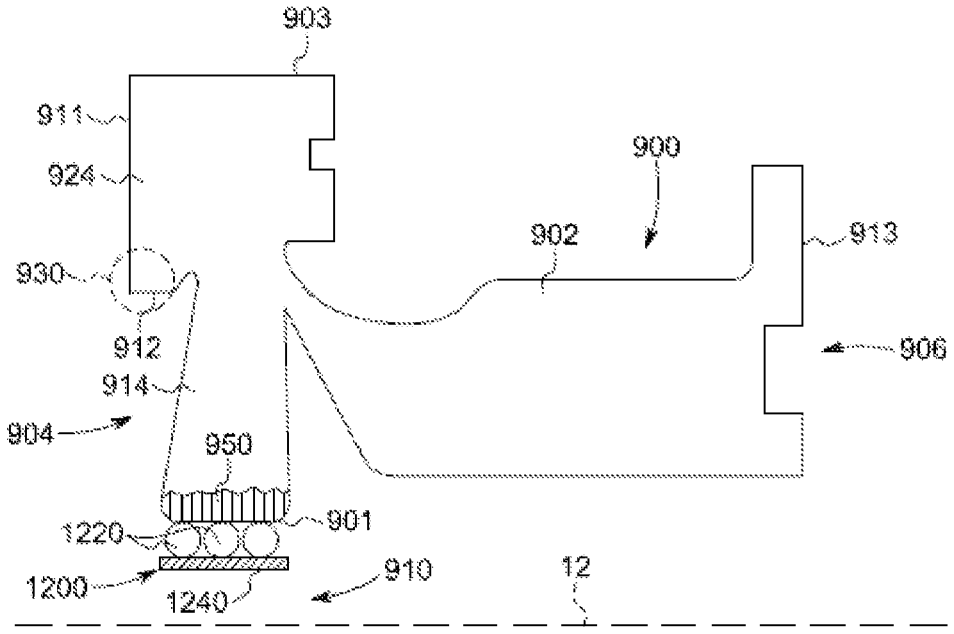
FIG. 11 is a cross-sectional side view of a portion of a fifth rotor disk and a corresponding fifth inductive heating fixture.
Figure 12:
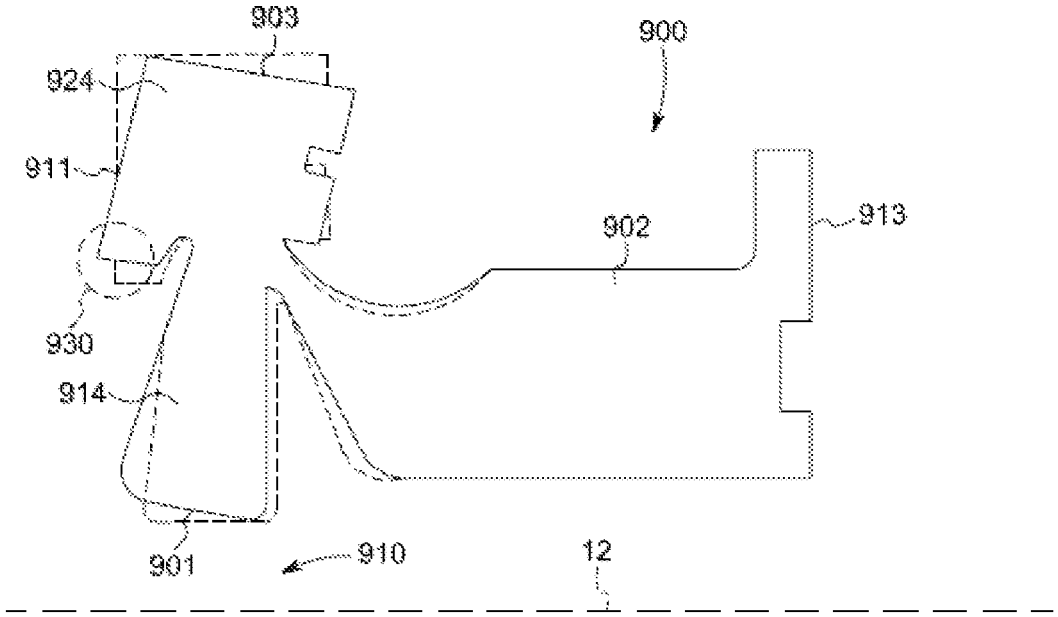
FIG. 12 is a cross-sectional side view of the portion of the fifth rotor disk, as shown in FIG. 11, in a deflected position.

FIG. 11 illustrates a rotor disk 900 in the process of being heated, and FIG. 12 illustrates the rotor disk 900 in a temporarily deflected state, following heating. The rotor disk 900 includes an axially elongated body 902 with a radially elongated upstream portion 904 and a radially shorter downstream portion 906. The radially elongated upstream portion 904 includes a base 914 and an annular band 924, which extends radially from the base 914 and which circumscribes the rotor bore 910.

The base 914 includes a radially inner surface 901, and the band 924 includes a radially outer surface 903, a radially intermediate surface 912, and an axially upstream surface 911. The band 924 also includes a connecting element 930 proximate to the interface between the upstream surface 911 and the radially intermediate surface 912. The downstream portion 906 of the rotor disk 900 includes an axially downstream surface 913.

In this exemplary rotor disk 900, a fixture 1200 is positioned adjacent the radially inner surface 901 of the base 914. As electrical current is applied through a heating coil 1220, which is held within a frame 1240, a localized area 950 of the base 914 is heated. The heating of the localized area 950 causes deflection primarily of the upstream portion 904 of the rotor disk 900, while the main body 902 of the rotor disk 900 remains unaffected, as shown in FIG. 12.

There is no requirement that a fixture (e.g., 200) include only a single inductive heating coil (e.g., 220). Rather, in some circumstances, it may be desirable to employ multiple coils 220 within the same fixture 200, each coil being separately connected to the controller 250. Additionally, there is no requirement that the inductive heating coils 220 used on a given rotor disk 100 have the same diameter. Rather, in some circumstances, it may be desirable to employ a first fixture 200 having an inductive heating coil 220 of a first diameter to selectively heat a first localized region 150 and a second fixture 200 having an inductive heating coil 220 of a second diameter to selectively heat a second localized region 150 (two exemplary regions 750A, 750B being shown in FIG. 9). Using coils 220 of different diameters may permit both regions 150 to be heated simultaneously to achieve the desired ramp rate and soak level for each region 150.

Whereas bulk heating of the rotor disk 100 using hot air blowers could require 10 to 12 hours depending on the dimensions of the rotor disk 100, inductive heating of the localized region(s) 150 using the fixtures 200 described herein can be accomplished in time periods ranging from 45 minutes to 4 hours, representing significant time and energy savings. Moreover, whereas a stacked rotor assembly having bulk-heated rotor disks may require as many as 24 hours to completely cool and form interference joints between adjacent rotor disks, the present stacked rotor assembly 10 with locally heated rotor disks 100 may be cooled in as few as 6 to 7 hours, reducing the build time for the entire gas turbine. The cool-down time is calculated between when a last rotor disk is installed and when the localized regions of the respective disks reach an ambient temperature.

The localized application of inductive heating may further be used to disassemble the stacked rotor assembly, if needed. To disassemble, the respective inductive heating fixture(s) for a given rotor disk are secured to the rotor disk and allowed to selectively heat the localized area(s), as needed to cause deflection and release the connecting element(s). Once the connecting element(s) are released, the rotor disk may be lifted from the stacked rotor assembly using a crane. The process may be repeated for subsequent rotor disks, as needed to fully disassemble the stacked rotor assembly or to reach a specific rotor disk for maintenance or replacement.

Exemplary embodiments of inductive heating fixtures and methods of using the same are described above in detail. The methods and systems described herein are not limited to the specific embodiments described herein, but rather, components of the methods and systems may be utilized independently and separately from other components described herein. For example, the methods and systems described herein may have other applications not limited to practice with gas turbine rotor assemblies, as described herein. Rather, the methods and systems described herein can be implemented and utilized in connection with various other industries.

While the technical advancements have been described in terms of various specific embodiments, those skilled in the art will recognize that the technical advancements can be practiced with modification within the spirit and scope of the claims.

What is claimed is:

1. A method of assembling a rotor comprising a plurality of rotor disks, each rotor disk of the plurality of rotor disks comprising a connecting element, the method comprising:

(a) applying heat to a localized region of a first rotor disk of the plurality of rotor disks to selectively deflect a first connecting element of the first rotor disk, wherein the first rotor disk is stationary during the applying of heat; wherein the applying heat to a localized region includes inductive heating using an inductive heating fixture temporarily attached in a stationary position to the rotor disk during the step of applying heat, and wherein the localized region of the rotor disk varies among the plurality of rotor disks;

(b) installing the first rotor disk;

(c) repeating steps (a) and (b) for each rotor disk of the plurality of rotor disks to form a stacked rotor assembly; and allowing the stacked rotor assembly to cool, wherein the respective connecting element of each rotor disk that has been selectively deflected contracts into an interference fit with an adjacent rotor disk, wherein the rotor disk defines a central rotor bore and the connecting element is disposed radially outboard of the central rotor bore; wherein the localized region is adjacent the central rotor bore; and wherein the method further comprises forming the inductive heating fixture for installation within the central rotor bore.

2. The method of claim 1, wherein the localized region of the rotor disk varies among the plurality of rotor disks.

3. The method of claim 2, wherein the applying heat to a localized region is accomplished at a ramp rate and a soak time.

4. The method of claim 3, wherein the soak time is between 30 minutes and 90 minutes for the respective rotor disk.

5. The method of claim 2, further comprising, prior to step (a), determining a location of the localized region of a respective rotor disk including the connecting element, one or more areas of the geometry suitable for attachment of the inductive heating fixture, and an amount of thermal deflection needed in the connecting element.

6. The method of claim 2, wherein the rotor disk comprises a first contact surface, a second contact surface opposite the first contact surface, and the connecting element extending from the first contact surface; wherein the applying heat to the localized region is accomplished by positioning the inductive heating fixture adjacent the second contact surface at a radial location opposite the connecting element.

7. The method of claim 2, wherein the connecting element of the rotor disk projects outwardly from an upstream surface of the rotor disk; and wherein the applying heat to the localized region is accomplished by positioning the inductive heating fixture adjacent the connecting element.

8. The method of claim 2, wherein the connecting element of the rotor disk is disposed at an interface between adjacent surfaces of the rotor disk; and wherein the applying heat to the localized region is accomplished by positioning the inductive heating fixture at a location distal to the interface.

9. The method of claim 2, wherein the connecting element of the rotor disk comprises the first connecting element and a second connecting element; and wherein the applying heat to the localized region is accomplished by positioning a first inductive heating fixture proximate to the first connecting element and a second inductive heating fixture to a surface opposite the second connecting element.

10. The method of claim 1, wherein the allowing the stacked rotor assembly to cool is accomplished over a cool-down time of between 6 hours and 8 hours, the cool-down time being calculated between when a last rotor disk is installed and when the localized regions of the respective disks reach an ambient temperature.

11. A gas turbine having a rotor assembly comprising a plurality of rotor disks interconnected to form a stacked rotor shaft, assembled according to the method of claim 1.

* * * * *